US006679600B1

(12) United States Patent
Regimbal

(10) Patent No.: US 6,679,600 B1
(45) Date of Patent: Jan. 20, 2004

(54) METHODS AND APPARATUS FOR INCREASING IMAGE GLOSS

(75) Inventor: Laurent A. Regimbal, Round Rock, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/202,161

(22) Filed: Jul. 24, 2002

(51) Int. Cl.[7] ..... B41J 2/01; G03G 15/20
(52) U.S. Cl. ..... 347/102; 399/330; 399/331
(58) Field of Search ..... 347/101, 102, 347/104, 156; 399/323, 400, 322, 397, 328, 331, 330, 401; 219/469–471, 216; 271/182, 301, 314

(56) References Cited

U.S. PATENT DOCUMENTS 6,246,036 B1 * 6/2001 Tsujimoto et al. ..... 219/619
6,419,222 B1 * 7/2002 Morrison et al. ..... 271/186

* cited by examiner

*Primary Examiner*—Stephen D. Meier
*Assistant Examiner*—An H. Do

(57) ABSTRACT

Apparatus and methods include various means of increasing the finish gloss of a printed image that is formed on a sheet of media by a deposition device. Apparatus in accordance with the present invention include a fusing circuit that enables the image to be repeatedly exposed to the heat of a fusing device while passing the media through the deposition device only once. Apparatus in accordance with the present invention can also include a fusing device that has a single hot roller and a plurality of pressure rollers that enable the image to be passed between the hot roller and each of the respective pressure rollers in succession. A method in accordance with the present invention includes repeatedly exposing the image to a fusing device.

11 Claims, 5 Drawing Sheets

METHODS AND APPARATUS FOR INCREASING IMAGE GLOSS

FIELD OF THE INVENTION

The invention claimed and disclosed herein pertains to methods and apparatus for producing images, and more particularly, to methods and apparatus for selectively producing images having increased gloss levels.

BACKGROUND OF THE INVENTION

Imaging devices are in widespread use and are well known in the art. The term "imaging device" includes any device that is configured to produce a visual image on an image media. Specific examples of imaging devices are printers, copiers, facsimile machines, and the like. Specific examples of image media are paper sheet, plastic film and the like.

Prior art imaging devices produce images by employing any of a number of various processes such as those known as inkjet, bubble jet, laser scanning, and the like. Each of these imaging processes is well known in the art and generally involves the deposition of an imaging substance on an image media to produce a visible image. Image substances include any substance that is configured to make up the image when deposited on the image media.

Specific examples of image substances are ink, powdered toner, and the like. An image that is produced by an imaging device is visible because of the contrast in light-reflecting characteristics between the image media and the image substance. A black image substance can be deposited on a white image media, for example, to create readable text.

Presently, one of the more popular imaging processes is that of laser scanning which is mentioned above. Imaging devices that employ the laser scanning imaging process are generally referred to as "laser printers," although the laser scanning process is employed in many types of imaging devices in addition to printers. The laser scanning imaging process (laser printing) generally involves selectively scanning at least one laser beam, or other light source, across an electrically charged photosensitive surface, which is generally referred to as an optical photo-conductor.

The laser is selectively scanned across the optical photo-conductor in accordance with a predetermined image which is to be produced. That is, the laser is selectively scanned across the optical photo-conductor so as to alter the relative electrical potential of respective portions thereof. The image, as a result of such scanning, is latently produced on the surface of the optical photo-conductor and is characterized by electro-statically charged portions of the optical photo-conductor as created by the selective scanning of the laser.

An imaging substance in the form of powdered toner is then applied to the surface of the optical photo-conductor. The toner generally adheres only to the selected portions of the optical photo-conductor, as created by the process of selectively scanning the laser beam across the surface of the photo-conductor. The toner that remains on the optical photo-conductor in the form of the predetermined image is ultimately transferred to an image media. The image media, along with the toner that makes up the image, is then heated in a fusing device in order to fuse the powdered toner into a plastic state. The toner then is allowed to cool, thereby becoming bonded to the media to produce the final image-product.

In addition to the above-mentioned processes, various other known processes can be employed to produce multi-color image-products such as multi-colored graphics and the like. Specifically, several toners of various colors can be employed to produce multi-colored image-products of varying quality, including near photo-quality image-products. Indeed, in some present markets, color laser printers, in combination with digital cameras and high-quality image media, are replacing traditional film processing and developing means in the photography industry.

Turning now to FIG. 1, a side-elevation schematic diagram is shown which depicts a prior art imaging apparatus 10. The prior art imaging apparatus 10 is configured to produce image-products in any of the manners generally described above. The prior art imaging device 10 comprises an in-feed tray 21 that is configured to support a stack of sheets of image media "M." A pick roller 23 is positioned as shown and is configured to pick single sheets of media "M" from the in-feed tray 21, and to feed each sheet of media into the imaging apparatus 10. The rotational direction of the pick roller 23, as well as those of other rotating components discussed below, are indicated by the respective arrows 29.

The imaging device 10 has a print path "PP" which can be defined by various components of the imaging device such as feed rollers 25. The print path "PP" can be defined by other various components such as guides, tracks (neither shown) and the like. It is understood that the means of moving the media "M" through the imaging apparatus 10 and along the print path "PP" is well understood in the art and will not be discussed in further detail herein. The media "M" is generally moved through the imaging apparatus 10 in the directions indicated by the arrows 30.

The print path "PP" proceeds from the in-feed tray 21 and pick roller 23 through various feed rollers 25 to a deposition device 40. The deposition device 40 is configured to deposit image substance (not shown), such as toner, onto the image media "M" by way of any of the various imaging processes that are discussed above. For example, the deposition device 40 can be configured to employ the above-discussed laser scanning process of depositing toner onto the image media "M."

If the laser scanning process is employed in conjunction with the deposition device 40, then a fusing device 50 is generally included in the apparatus 10. The fusing device 50 typically comprises a hot roller 51 and a pressure roller 52. The hot roller 51 is typically configured to convert electrical energy to heat energy. That is, the hot roller 51 typically includes a heating element or the like to produce heat.

Image media "M" is passed between the hot roller 51 and the pressure roller 52 during the fusing process. The pressure roller 52 is configured to press the media "M" against the hot roller 51 in order to optimize the amount of heat energy transferred from the hot roller 51 to the media "M." The pressure roller 52 is typically not heated. However, it is understood that the pressure roller 52 can comprise a heating element so as to be heated in the manner of the hot roller 51.

Thus, at the fusing device 50, the image media "M," along with the toner deposited thereon, are heated so as to fuse the toner together and bond the toner to the respective sheet of media to create a finished image-product. The image, and thus the toner, is typically directly exposed to a heat source such as the hot roller 51 during passage of the image media "M" through the fusing device 50.

Thus, the references made herein to the image media "M" and/or the image as being "exposed to the fusing device" mean that the image is exposed directly to a heated object, which is usually the hot roller 51, but can be a heated pressure roller 52. The print path "PP" proceeds from the deposition device 40 to the fusing device 50 and on through various feed rollers 25 to an out-feed tray 22 in which the media "M" are deposited.

As further seen, the prior art imaging apparatus 10 can comprise an optional duplex circuit 60. The duplex circuit 60 is essentially an optional auxiliary media path that can be incorporated into an imaging apparatus and employed for duplex imaging (printing images on both sides of a given sheet of image media "M"). Various feed rollers 25, as well as other components such as guides, tracks (neither shown) and the like, can be included in the prior art imaging apparatus 10 for the purpose of moving sheets of media "M" along the duplex circuit 60 in the directions indicated by the arrows 30.

One of the primary functions of the duplex circuit 60 is to remove a given sheet of media "M" from the print path "PP" downstream of the fusing device 50 and before the sheet reaches the out-feed tray 22 after a first image (not shown) has been produced on a first side of the sheet. Another primary function of the duplex circuit 60 is to turn the sheet of media "M" over relative to the print path "PP" and the deposition device 40 so that the second side of the sheet can be exposed to the deposition device for deposition of the second image (not shown) on the second side of the sheet.

Yet another function of the duplex circuit 60 is to move the sheet of media "M" from the downstream side of the fusing device 50 to the upstream side of the deposition device 40, where the sheet is re-introduced to the print path "PP." Thus, while the prior art duplex circuit 60 provides for exposure of a given sheet of media "M" to the fusing device 50 more than one time, a given image that is supported on the given sheet of media is exposed directly to the hot roller 51 not more than one time. The significance of this will become more apparent in light of the description below of the various aspects of the present invention.

A shunting device 62 can be included in the prior art imaging device 10 in order to selectively divert a given sheet of media "M" from the print path downstream of the fusing device 50. The shunting device 62 can be configured in any of a number of manners including that of a selectively operated diverter gate or the like. The shunting device 62 can be automatically operated by a controller (not shown) or other like device which is typically employed to control the operation of the various components of the prior art apparatus 10. Furthermore, the shunting device 62 typically includes an actuator (not shown) such as a solenoid, air cylinder or the like, that can be selectively controlled by a controller or the like.

The duplex circuit 60 typically includes a half-loop 64 that comprises a portion of the duplex circuit, as shown. The half-loop 64 causes a given sheet of image media "M" to turn upside down relative to the print path "PP" and also causes the direction of the given sheet to change by about 180 degrees. As shown in the specific example that is illustrated in FIG. 1, the half-loop 64 is configured to cause a given sheet of image media "M" to turn upside down as well as change its direction approximately 180 degrees relative to the print path "PP" so that the sheet can be moved from the downstream side of the deposition device 40 to the upstream side thereof.

Additionally, the duplex circuit 60 typically includes a reversing leg 66. The prior art apparatus 10 can also include a diverter 68 as well as a set of reversible rollers 70 which are configured to selectively and synchronously rotate in either direction as indicated by the arrows 71. The reversing leg 66, in conjunction with the diverter 68 and rollers 70, is employed to reverse the direction of the given sheet of image media "M" without turning the sheet upside down.

That is, as shown in the specific example that is illustrated, the given sheet of media "M" moves into the reversing leg 66 before stopping and completely reversing its direction with the assistance of the reversible rollers 70. As the given sheet of media "M" exits the reversing leg 66, the diverter 68 causes the sheet to be diverted along the duplex circuit 60 as indicated by the arrows 30 and toward the print path "PP."

It is noted that the diverter 68 can be configured so as to be controllable in the general manner in which the shunting device 62 is controlled as mentioned above. More typically, however, the diverter 68 is a fully automatic self-contained device that is not controlled by a typical controller or the like. That is, the operation of the diverter device 68, in a more typical application, can be likened to that of a self-contained, automatically operating one-way check valve, or the like.

Thus, the diverter 68 can typically be configured to include a spring-loaded gate or the like that allows a given sheet of media "M" to enter the reversing leg 66 from a first section of the duplex circuit 60. Then, the diverter device 68 automatically diverts the given sheet of media "M" onto a second section of the duplex circuit 60 as the sheet exits the reversing leg.

It is understood that the relative positions of the half-loop and the reversing leg 66 can be reversed from that described above and shown in FIG. 1. That is, the reversing leg 66 and half-loop 64 can be placed on the duplex circuit 60 so that a given sheet of media "M," while being moved along the duplex circuit, is first moved through the reversing leg before being moved through the half-loop.

As is evident, the given sheet of media "M," once it is turned over and moved upstream of the deposition device 50, is then caused to merge onto the print path "PP" upstream of the deposition device 40. Once the given sheet "M" is back on the print path "PP," the sheet moves through the deposition device 40 and a second image is deposited onto the second side of the sheet.

The sheet of media "M" is then moved through the fusing device 50 whereupon the second image is directly exposed to the hot roller 51 to be fused and bonded to the sheet. Once the second image is thus fused and bonded, the sheet "M" moves through the shunting device 62 along the print path "PP" and proceeds directly to the out-feed tray 22 without being withdrawn onto the duplex circuit 60.

Some prior art imaging devices are configured to selectively produce images having an increased level of finish gloss. An increased level of image finish gloss can be particularly desirable in producing high-quality graphics, and especially photo-quality images. An image comprising powdered toner can be made glossier by putting a smoother finish on the fused toner. In prior art imaging devices, such an increased level of image gloss is generally accomplished by moving the image and respective sheet of media "M" along the print path "PP" and through the fusing device 50 at reduced processing speeds.

That is, an image that is to have an increased level of finish gloss is fed along the print path "PP" and through the fusing device 50 more slowly than is an image that is to have a normal finish. This is generally accomplished in conjunction with prior art imaging apparatus by configuring the print path "PP," and all related components thereon, such as the deposition device 40 and the fusing device 50, to have a slow speed which is utilized for producing images having increased gloss levels. For example, before a given sheet of media "M" receives an image that is to have an increased level of gloss, the print path "PP" and related components of the prior art imaging apparatus 10 are switched to slow speed.

However, before the imaging apparatus 10 is switched to slow speed, the print path "PP" must be "flushed" of imaging media. That is, before the prior art imaging apparatus 10 is switched to slow speed in anticipation of the production of a high-gloss image, the previously introduced sheets of media "M" which are "in process," and which do not receive high-gloss images, must be completely cycled out of the print path "PP." Thus, before the prior art imaging apparatus 10 is switched to slow speed for production of a high-gloss image, a given period of time must elapse in order to allow the "in process" sheets of media "M," which are not to receive a normal image and not a high-gloss image, to complete the image-production process at normal speed.

After the prior art imaging apparatus 10 is "flushed" of "normal image" imaging media "M," the print path "PP" and related components are switched to slow speed in anticipation of the production of a "high-gloss" image on a designated sheet of media "M." The switching of the print path "PP" and related components to slow speed is preferably accomplished automatically in conjunction with a controller device, or the like. That is, preferably, a controller (not shown) is employed and configured to automatically switch the print path "PP" and related components to slow speed in response to an operator command which designates a predetermined image as a "high-gloss" image.

After the print path "PP" and related components are switched to slow speed, a selected sheet of image media "M" which is to receive the high-gloss image is picked from the stack of media on the in-feed tray 21. The given sheet of media "M" is moved along the print path "PP" at slow speed in the direction indicated by the arrows 30 by the respective feed rollers 25 and other various known conveying means which are not shown.

The given sheet of media "M" then moves through the deposition device 40 at slow speed where a given image (not shown) is deposited onto the given sheet of media. The given sheet of media "M" which bears the given image which is to have increased gloss then proceeds through the fusing device 50 at the slow speed. Because of the reduced operational rate, or slow speed, of the fusing device, the increased level of heat energy transferred to the image results in an increase of the finish gloss of the given image. The given sheet of media "M" is then moved along the remainder of the print path "PP" at slow speed and into the out-feed tray 22.

Alternatively, after passing through the fusing device 50, the given sheet of media "M" can be diverted onto the duplex circuit 60 to be moved upstream of the deposition device 40 and to be turned over. Thus, alternatively, the given sheet of media "M" which bears the given image can be passed again through the deposition device 40 as well as the fusing device 50 so as to bear an image on each of the sheet's two sides.

Both of the images on the duplex sheet can be made to have increased levels of gloss in the manner described above, wherein each image is deposited and fused at the slow speed of the print path "PP," the deposition device 40, and the fusing device 50. Alternatively, only one of the images on a duplex sheet can be made to have an increased level of gloss while the other image is made to have a normal level of gloss. It is noted that after a given sheet of image media "M," which has had a high-gloss image produced thereon, has exited the print path "PP" and has been deposited on the out-feed tray 22, the prior art imaging apparatus 10 can be switched back to normal speed, and the production of images having normal levels of gloss can resume.

Turning now to FIG. 2, a flow diagram 80 is shown which depicts some of the typical steps of a prior art process for producing an image having an increased level of gloss. The process begins at step S81. The steps of the flow diagram 80 can be performed, for example, in conjunction with an imaging device such as the imaging apparatus 10 which is described above and shown in FIG. 1. With reference to both FIGS. 1 and 2, the next step of the process 80 is that of step S83, in accordance with which a sheet of media "M" is designated as one which is to receive a high-gloss image.

In accordance with the next step of S85, the print path "PP" is flushed ahead of the designated sheet of media as is described above. In accordance with the next step of S87, the processing speed of the print path "PP" is reduced upon completion of the flushing process. The reduction in processing speed of the print path "PP" includes reducing the processing speed of the deposition device 40, as well as the fusing device 50, and the various feed rollers 25 and the like.

In accordance with step S89, the designated sheet of media is fed along the print path "PP" at the reduced processing speed, wherein the designated sheet of media receives an image from the deposition device 40, and is exposed to the fusing device 50, both at reduced processing speed. The print path "PP" is then flushed upon completion of the production of the high-gloss image on the designated sheet of media, in accordance with step S91. Moving to step S93, the designated sheet of media is deposited in the out-feed tray 22. The production of images at normal processing speed resumes in accordance with step S95. The process of producing a high-gloss image ends at step S97.

As is evident from the preceding discussion, prior art imaging devices are typically configured to produce images having increased levels of gloss. However, the process employed by prior art devices for producing the increased levels of gloss comprises slowing the process speed of the entire print path "PP," including the deposition device 40 and the fusing device 50. The image media and image are then passed along the print path "PP" and through the deposition device 40 and fusing device 50 at the slower speed. The reduced processing speed, however, can pose several problems.

One problem caused by the slower processing speed of prior art gloss processes is that the overall production rate of the imaging device 10 is also correspondingly slowed. In order to produce images having increased levels of gloss, prior art imaging devices typically must decrease overall processing speed to 33% of normal processing speed in some cases. This can cause a significant decrease in production rate of the imaging apparatus. Additionally, before the processing speed is decreased for production of the high-gloss image, the entire print path must be flushed, or cleared, of image media having images of normal gloss levels. This can cause a further decrease in the production rate of the prior art imaging apparatus 10.

Another problem associated with prior art image gloss processes is that a decrease in overall processing speed of the print path and related components such as the deposition device and fusing device can have an adverse effect on various imaging parameters such as color plane registration and the like which, in turn, can cause a decrease in image-product quality.

What are needed then are imaging apparatus and methods which achieve the benefits to be derived from similar prior art methods and/or devices, but which avoid the shortcomings and detriments individually associated therewith.

SUMMARY OF THE INVENTION

In accordance with one embodiment of the present invention, an imaging apparatus consists of a fusing device and a fusing circuit. The apparatus can also comprise a deposition device which is configured to deposit an image on a sheet of media. The fusing circuit is a media path that selectively enables an image on a given sheet of media to be repeatedly exposed to the fusing device without repeatedly passing through the deposition device. That is, the fusing circuit can cause the image to be exposed to the fusing device more than once so as to increase the finish gloss of the image, while not passing through the deposition device. The fusing circuit allows such repeated exposure of the image to the fusing device during normal processing speeds of the fusing device.

An imaging device in accordance with another embodiment of the present invention can include a fusing device having a single hot roller and a plurality of pressure rollers. For example, a fusing device of the present invention can have a single hot roller and two pressure rollers. Alternatively, a fusing device of the present invention can have a single hot roller and three pressure rollers. Any of the pressure rollers can be heated, in the alternative. Such an apparatus can further include a fusing circuit, a print path configured to convey sheets of media, and a shunting device configured to selectively divert a given sheet of media from the print path onto the fusing circuit.

In accordance with another embodiment of the present invention, a method of increasing the gloss of an image includes the steps of providing a fusing device and repeatedly exposing the image to a fusing device without passing the associated imaging media through a deposition device. As a specific example, the method can include the steps of exposing the image to the fusing device a first time and exposing the image to the fusing device a second time. The method can further increase the finish gloss of the image by the step of exposing the image to the fusing device a third time.

These and other aspects and embodiments of the present invention will now be described in detail with reference to the accompanying drawings, wherein:

DETAILED DESCRIPTION OF THE INVENTION

Figure 1:
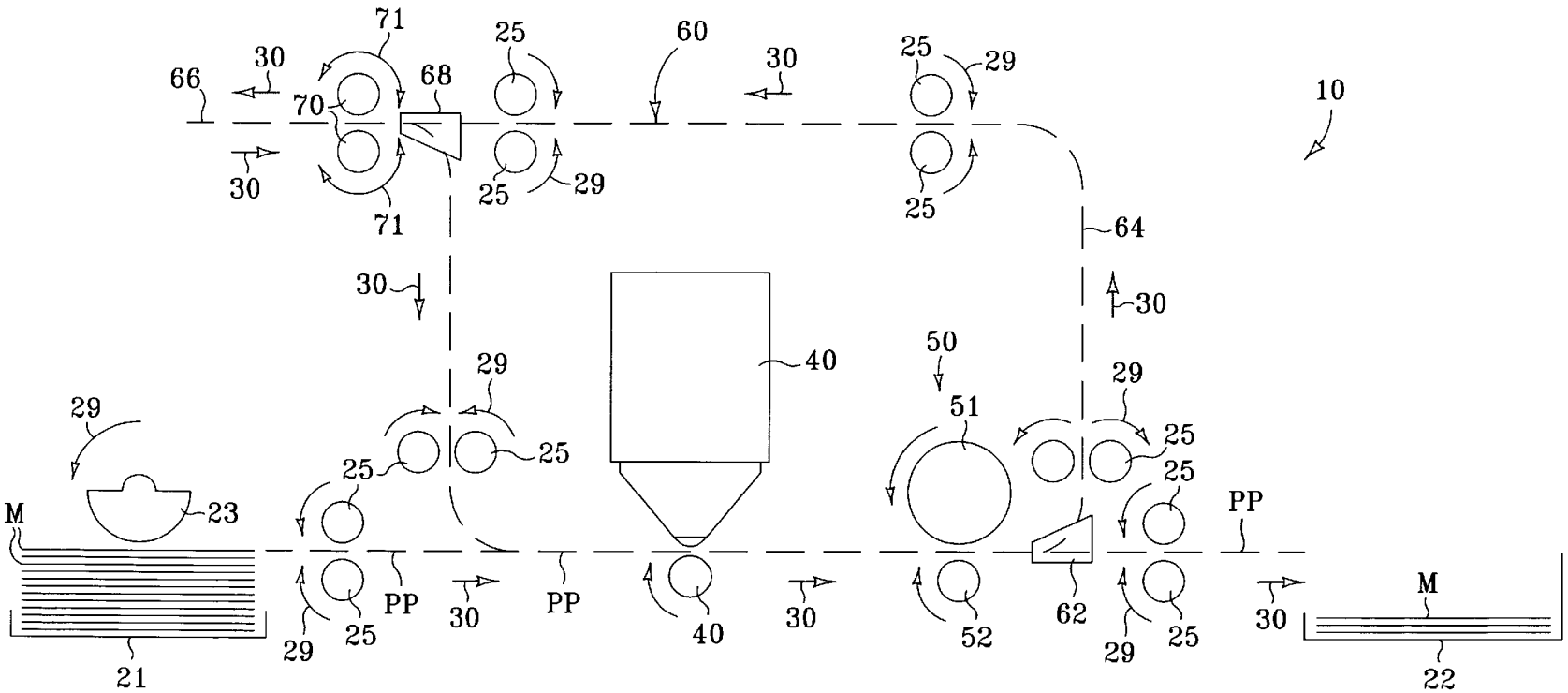
FIG. 1 (Prior Art)
FIG. 1 is a side elevation schematic diagram of a prior art imaging apparatus.
Figure 2:
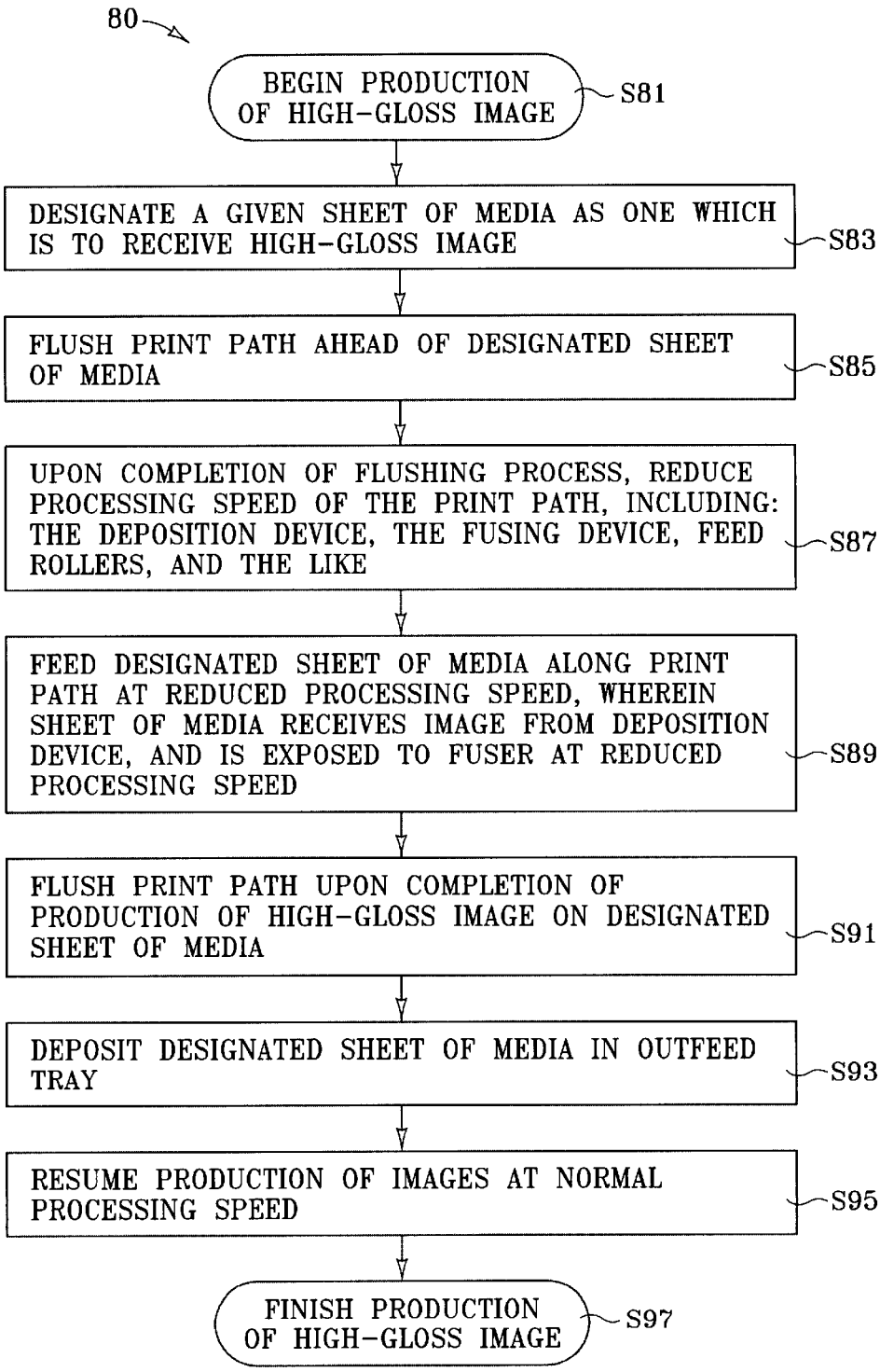
FIG. 2 (Prior Art)
FIG. 2 is a flow chart which depicts steps in a prior art procedure for producing an image having increased finish gloss.

The invention concerns apparatus and methods for increasing the finish gloss of a printed image. Apparatus in accordance with the present invention include a fusing circuit which allows a given image to be selectively and repeatedly exposed to a fusing device in order to increase the finish gloss of the image. This process can be performed at normal processing speeds of the fusing device. At least one apparatus in accordance with the present invention includes a fusing circuit that circumscribes the fusing device, while another apparatus includes a fusing circuit that does not circumscribe the fusing device. Moreover, at least one apparatus in accordance with the present invention includes a fusing device that has a single hot roller and a plurality of pressure rollers, wherein an image can be passed in succession between the hot roller and each respective pressure roller. In accordance with yet another embodiment of the present invention, a method of increasing the finish gloss of an image includes repeatedly exposing the image to a fusing device.

The fusing circuit, in accordance with each of several alternative embodiments of the present invention, can have any of a number of respective forms including those described herein below as a Siamese wishbone, a full loop, a single parallel siding, and a double parallel siding, among others. That is, in accordance with one embodiment of the present invention, an imaging apparatus comprises a fusing circuit having a Siamese wishbone form. In accordance with another embodiment of the present invention, an imaging apparatus comprises a fusing circuit having a full loop form. In accordance with yet another embodiment of the present invention, an imaging apparatus comprises a fusing circuit having a parallel siding form.

The Siamese wishbone form of the fusing circuit preferably comprises a first reversing leg, a second reversing leg, a shunting device, and a pair of diverters. Movement of sheets of media along the Siamese wishbone form of fusing device is discontinuous in that the media stops, if only instantaneously, twice along the circuit. The Siamese wishbone form of the fusing circuit substantially circumscribes, or surrounds, the fusing device, but does not surround the deposition device.

The full loop form of fusing circuit also circumscribes, or surrounds the fusing device, while not surrounding the deposition device. The full loop form of the fusing circuit preferably comprises a shunting device. Movement of the media along the full loop form of the fusing circuit can be continuous in that the media need not stop during circulation thereof along the fusing circuit. Any of the embodiments of the present invention can comprise a duplex circuit. Alternatively, any of the embodiments of the present invention can be incorporated into the duplex circuit.

In a more detailed description of one embodiment of the present invention, an imaging apparatus includes a fusing circuit and print path that is configured to convey sheets of media. The apparatus also comprises a shunting device that is configured to selectively divert a given sheet of media from the print path and onto the fusing circuit. In the case wherein the apparatus has a Siamese wishbone form, the apparatus includes a first reversing leg and a second reversing leg which each form a respective portion of the fusing circuit. The apparatus can also include a deposition device that is located on the print path. Preferably, the fusing device is located on the print path and downstream from the deposition device. The fusing circuit can thus substantially circumscribe the fusing device while the deposition device lies outside the fusing circuit.

When the shunting device diverts the given sheet of media onto the fusing circuit, the given sheet of media can successively pass between the hot roller and each of the plurality of pressure rollers. As an illustrative example, if the apparatus includes a fusing device having a single hot roller and two pressure rollers, then the sheet of media can be made to pass between the hot roller and each of the two pressure rollers in succession. On the other hand, when the shunting device does not divert the given sheet of media onto the fusing circuit, the given sheet passes between the hot roller and only one of the two pressure rollers.

As mentioned above, the present invention includes at least one method of increasing the finish gloss of an image. A more detailed version of the method includes the step of providing a print path, wherein the fusing device is located on the print path. A deposition device can also be provided, wherein the deposition device is located on the print path upstream of the fusing device. The image can thus be removed from the print path downstream of the fusing device and can then be merged back onto the print path upstream of the fusing device and downstream of the deposition device. This enables the image to be repeatedly exposed to the fusing device.

The fusing device can be configured to operate at a normal processing speed during the repeated exposure of the image to the fusing device in accordance with the method of the present invention. Also, the method can include the steps of providing a fusing device having a single hot roller and a plurality of pressure rollers and successively passing the image between the hot roller and each of the pressure rollers.

Figure 3:
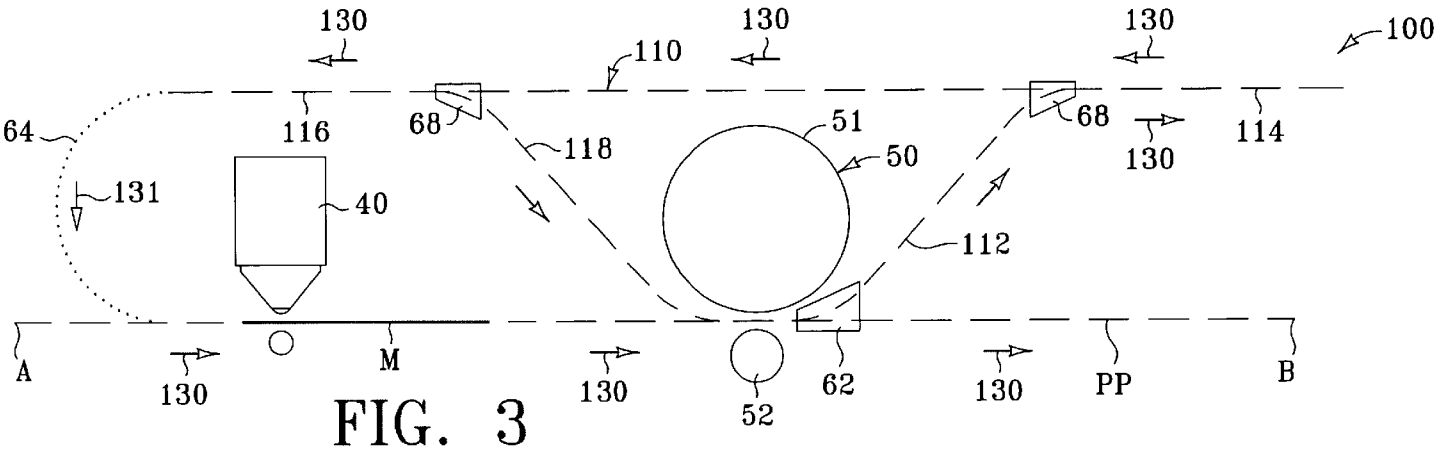
FIG. 3 is a side elevation schematic diagram depicting an imaging apparatus in accordance with one embodiment of the present invention.

Specific, non-limiting examples of the present invention with respect to the accompanying drawings will now be described. Turning now to FIG. 3, a side-elevation schematic diagram is shown in which an imaging apparatus 100 in accordance with one embodiment of the present invention is depicted. As is seen, the apparatus 100 comprises a fusing device 50 that includes a hot roller 51 and a pressure roller 52. The configuration and operation of the fusing device 50 has been described above with respect to the prior art.

As will become more apparent in later discussion, neither the fusing device 50, nor any portion of the print path "PP" such as the deposition device 40 and the like, as utilized in conjunction with the various embodiments of the present invention, require the capability to slow to a speed that is less than the normal processing speed thereof. That is, the fusing device 50, as well as the deposition device 40 and print path "PP," which are included in the apparatus 100, as well as in other embodiments of the present invention, are required only to operate at a normal processing speed, unlike similar devices of the prior art which are slowed to a decreased operating speed during production of high-gloss images, as explained above.

The apparatus 100 can comprise a deposition device 40. The configuration and operation of the deposition device 40 has also been described above with respect to the prior art. As is also mentioned above, a print path "PP" is included in the apparatus 100. The print path "PP" leads from point "A" to point "B." Point "A" can be, for example, an in-feed tray (not shown) or the like. Similarly, point "B" can be an out-feed tray (not shown) or the like. The apparatus 100 is configured to convey a sheet of image media "M" along the print path "PP" in the direction indicated by the arrows 130.

The print path "PP" is preferably defined by various media conveying means such as feed rollers, guides, and the like (not shown). Means of conveying image media along a print path are well understood in the art and have also been briefly discussed above with respect to the prior art. Since such means of moving image media along a print path are well known, further details of such means will not be discussed herein except in particular cases wherein discussion of certain aspects of such means are intended to facilitate the understanding of the present invention.

The apparatus 100 comprises a fusing circuit 110 that is preferably defined by various known media-conveying devices such as feed rollers, guides and the like (not shown) which are described above with respect to the prior art. The term "fusing circuit" as used herein means a media path that is configured to convey media relative to a given fusing device so as to enable a given image borne by the media to be repeatedly exposed to the given fusing device in order to increase the gloss of the given image. The term "repeatedly exposed" as used herein means exposed more than once.

As seen, the fusing circuit 110 can be configured so as to circumscribe the hot roller 51 of the fusing device 50. Although not shown, the fusing circuit 110 can alternatively be configured with similar effect in a manner wherein the pressure roller 52 of the fusing device 50, rather than the hot roller 51, is circumscribed by the fusing circuit. It is noted that the deposition device 40 is not circumscribed, nor surrounded in any manner, by the fusing circuit 110.

A study of FIG. 3 reveals that the fusing circuit 110 can be referred to as having a "Siamese Wishbone" form because the path of the fusing circuit resembles two wishbones that are connected together in the manner of Siamese twins. Particularly, the fusing circuit 110 having the Siamese Wishbone form comprises a diverging leg 112, a first reversing leg 114, a second reversing leg 116, and a merging leg 118. The apparatus 110 also preferably comprises a shunting device 62 as well as a pair of diverters 68. The shunting device 62 and the diverters 68 have been described above with respect to the prior art.

One or more sheets of image media "M" can be moved along the fusing circuit 110 in the directions indicated by the respective arrows 130. The purpose of the fusing circuit 110, as will become apparent, is to enable the imaging apparatus 100 to produce an image having an increased finish gloss without decreasing the processing speed of the fusing device 50, or any other related components.

This is accomplished in accordance with the present invention by repeatedly exposing the image to the hot roller 51 of the fusing device 50 at normal processing speeds of the fusing device. Alternatively, an image not having an increased level of gloss can be produced by the apparatus by simply allowing a given sheet of media "M" to move continuously along the print path "PP" directly from point "A" to point "B" and not repeatedly exposing the given sheet to the hot roller 51 of the fusing device 50.

An illustrative operational description of the fusing circuit 110 will now be provided. As a given sheet of image media "M" proceeds along the print path "PP" from point "A" in the direction 130, a given image is deposited on the given sheet as the sheet passes the deposition device 40. It is assumed for the purposes of this illustrative description that the given image is to have an increased level of finish gloss. From the deposition device 40, the given sheet of media "M" proceeds along the print path "PP" to the fusing device 50. The print path "PP," as well as the deposition device 40 and the fusing device 50, maintain a normal processing speed throughout the entire image production process.

As the given sheet of media "M" passes the fusing device 50, the shunting device 62 is actuated so that the given sheet is diverted off of the print path "PP" and onto the diverging leg 112. The actuation of the shunting device 62 can be automatically controlled by a controller (not shown) or the like. Controllers are typically employed to control various operational aspects of prior art imaging devices as described above. Such utilization of controllers is well known and understood in the art.

Thus, the shunting device 62, as well as any other components of the present invention, can be controlled by known means in a manner which will result in the automatic control of the various operational sequences in accordance with the present invention, which are described herein. Specifically, for example, the shunting device 62 can be controlled so that sheets of media "M" which bear images that are to have increased finish gloss are automatically diverted onto the fusing circuit 110 while those sheets of media that bear images which are not to have increased finish gloss are not diverted onto the fusing circuit and are allowed to proceed directly toward point "B."

Once the given sheet of media "M" is diverted onto the diverging leg 112, the given sheet is moved through the respective diverter 68 and into the first reversing leg 114 where the sheet stops. The given sheet of media "M" is then moved back out of the first reversing leg 114 and again through the respective diverter 68 to the second reversing leg 116 where the sheet again stops. The given sheet of media "M" is then moved out of the second reversing leg 116 and through the respective diverter 68 onto the merging leg 118. From the merging leg 118, the given sheet of media "M" merges onto the print path "PP" upstream of the fusing device 50, but down stream of the deposition device 40, as shown.

After the given sheet of media "M" is merged onto the print path "PP," the sheet is passed through the fusing device 50 a second time at normal processing speeds thereof. The second exposure of the image to the fusing device 50 gives the image an increased level of finish gloss. The above procedure can be repeated any number of times to further increase the image finish gloss.

That is, the image can be sent through the fusing device 50 a third time in the manner described above so as to further increase the level of image gloss. When the desired level of image finish gloss has been attained, the respective sheet of media "M" is allowed by the shunting device 62 to proceed along the print path "PP" from the fusing device 50 directly to point "B."

As is seen, the fusing circuit 110 is configured to remove a given sheet of media "M" from the print path "PP" at a point downstream of the fusing device 50. The fusing circuit 110 is further configured to convey the given sheet of media "M" to a location where the given sheet can be allowed to merge back onto the print path "PP." This location at which the sheet of media "M" merges back onto the print path "P" is upstream of the fusing device 50 and downstream of the deposition device 40.

Moreover, it is noted that the orientation of the sheet of media "M" on the print path "PP" relative to the fusing device 50 is not altered by the fusing circuit 110. That is, the fusing circuit 110 does not flip the sheet upside down relative to the fusing device 50 as in the manner of a duplex circuit which is described above, for example. Thus, in conjunction with the use of a duplex circuit of the present invention, a given sheet of media "M" can be fed through the fusing device 50 two or more times at normal processing speed, wherein a given image on the sheet is repeatedly exposed to the hot roller 51 so as to produce an image having an increased finish gloss.

It is noted that movement of media "M" along the fusing circuit 110 of the imaging apparatus 100 is discontinuous. That is, the media "M" cannot move continuously along the fusing circuit 110 because the direction of travel of the media relative to the print path "PP" is reversed at each of the reversing legs 114, 116. It is further understood that, as a given sheet of media "M" is moved along the fusing circuit 110, another sheet of media can be moved through the fusing device 50 along the print path "PP."

In this manner, the flow of media "M" along the print path "PP" does not necessarily have to be stopped during the gloss mode in accordance with the present invention. Additionally, it is understood that the fusing circuit 110 can be incorporated into a duplex circuit or the like. Duplex circuits are described above with respect to the prior art.

As is illustrated in FIG. 3, the half loop 64 is depicted as a dotted line and is connected between the second reversing leg 116 and the print path "PP" upstream of the deposition device 40. A sheet of media "M" can be conveyed along the half loop 64 in the direction indicated by the arrow 131. Thus, the fusing circuit 110, in conjunction with the half loop 64, can function as a duplex circuit in the manner described above with respect to the prior art. Alternatively, the apparatus 100 can include a separate duplex circuit (not shown) of which the fusing circuit 110 does not comprise a portion of such a duplex circuit.

Figure 4:
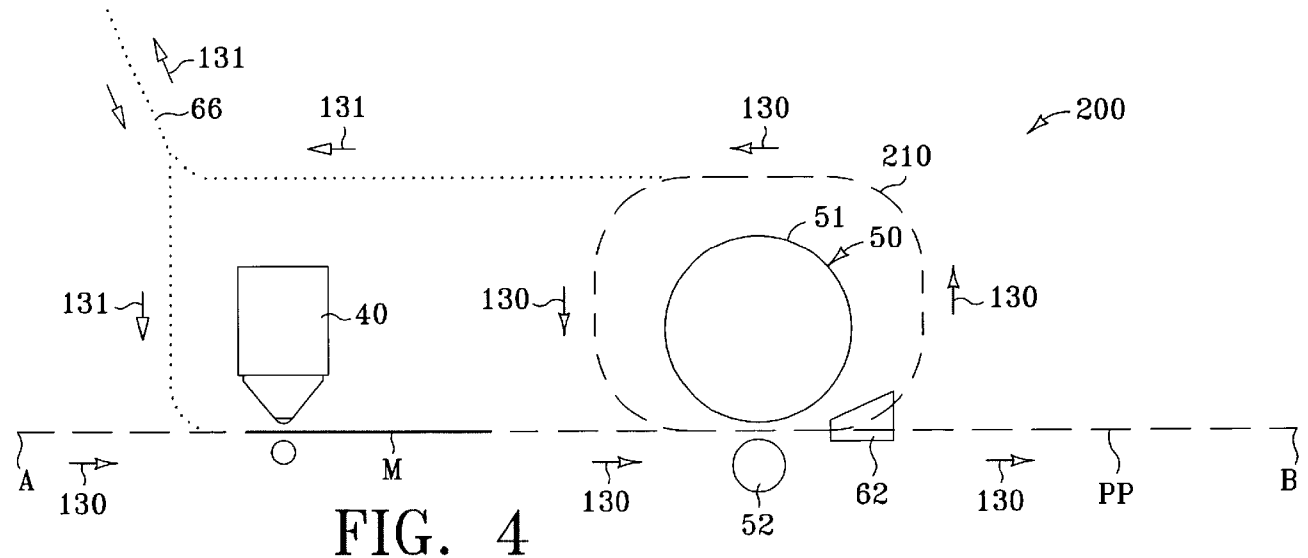
FIG. 4 is a side elevation schematic diagram depicting an imaging apparatus in accordance with another embodiment of the present invention.

Moving now to FIG. 4, a side-elevation schematic diagram is shown in which an imaging apparatus 200 in accordance with another embodiment of the present invention is depicted. The apparatus 200 comprises a fusing device 50 that includes a hot roller 51 and a pressure roller 52 as in the apparatus 100 which is described above. That is, the fusing device 50 that is included in the apparatus 200 has been explained above with respect to the prior art.

The apparatus 200 can also comprise a deposition device 40. The deposition device 40 has been described above. The apparatus 200 preferably includes a print path "PP" as shown wherein the deposition device 40 is preferably located upstream of the fusing device 50 relative to the print path. The print path "PP" leads from point "A" to point "B" while passing through the deposition device 40 and the fusing device 50 as shown.

Furthermore, the apparatus 200 is configured to convey a sheet of image media "M" along the print path "PP" in the direction indicated by the arrows 130. The print path is preferably defined by any of a number of known media conveying means as described above with respect to the apparatus 100. As explained above with respect to the apparatus 100, neither the print path "PP," nor the deposition device 40, nor the fusing device 50, as used in conjunction with the apparatus 200 need have the capability to operate at a decreased processing speed that is less than a normal processing speed.

As is seen, the apparatus 200 comprises a fusing circuit 210 that is preferably defined by various known media-conveying devices such as feed rollers, guides and the like (not shown) which are described above with respect to the prior art. As is also seen, the fusing circuit 210 circumscribes the hot roller 51 of the fusing device 50. Although not depicted, the fusing circuit 210 can alternatively be configured with similar effect in a manner wherein the pressure roller 52 of the fusing device 50, rather than the hot roller 51, is circumscribed by the fusing circuit. It is noted that the deposition device 40 is not circumscribed, nor surrounded in any manner, by the fusing circuit 210.

A study of FIG. 4 reveals that the fusing circuit 210 can be referred to as having a "full loop" form because the media "M" passes along the path of the fusing circuit in a manner that resembles the path of an aircraft while performing an aerobatic maneuver known as a full loop. The apparatus 200 also preferably comprises a shunting device 62 which has been described above. A major function of the fusing circuit 210 is to enable the imaging apparatus 200 to repeatedly expose a given image to the fusing device 50 in order to increase the finish gloss of the given image.

That is, the fusing circuit 210 is configured to circulate media "M" from downstream of the fusing device 50 to a location upstream of the fusing device in order to allow a given sheet of media to be repeatedly exposed to the fusing device. It is noted that movement of media "M" along the fusing circuit 210 can be continuous because the media can move along the entire length of the fusing circuit without stopping or reversing direction relative to the fusing circuit.

During operation of the apparatus 200, the shunting device 62 can be selectively operated so as to divert a predetermined, given sheet of media "M" from the print path "PP" at a point that is downstream of the fusing device 50, and onto the fusing circuit 210. Once the given sheet of media "M" has been diverted onto the fusing circuit 210, the given sheet is moved along the fusing circuit 210 in the direction indicated by the respective arrows 130. As is seen, the given sheet of media "M" is ultimately caused to merge back onto the print path "PP" upstream of the fusing device 50 and downstream of the deposition device 40.

It is noted that the orientation of the given sheet of media "M" on the print path "PP" relative to the fusing device 50 is not changed by the fusing circuit 210. That is, the fusing circuit 210 does not cause the given sheet of media "M" to turn upside down relative to passage thereof through the fusing device 50, as does a duplex circuit. Thus, the fusing circuit 210 is configured to selectively relocate a predetermined sheet of media "M" from downstream of the fusing device 50 to a position upstream of the fusing device in order to facilitate multiple exposures to the fusing device of a predetermined sheet of image media. Such multiple exposures of a given sheet of image media to the fusing device can increase the finish gloss of an image supported on the media.

Thus, when a given sheet of media "M" is designated as bearing an image which is to have increased finish gloss, the sheet first proceeds along the print path "PP" at normal processing speed through the deposition device 40 in the direction 130. The designated sheet of media "M" then passes, at normal processing speed, through the fusing device 50 a first time, whereupon the image is exposed a first time to the hot roller 51 at a normal processing speed of the fusing device. The shunting device 62 is caused to divert the given sheet of media "M" from the print path "PP" downstream of the fusing device 50 and onto the fusing circuit 210. The actuation of shunting device 62 can be controlled by way of a controller (not shown) or the like in the manner described above for the apparatus 100.

After being diverted by the shunting device 62 onto the fusing circuit 210, the sheet of media "M" is caused by various imaging media conveying components of the apparatus 200 to circulate along the fusing circuit in the direction indicated by the respective arrows 130. Upon moving completely along the fusing circuit 210, the given sheet of media "M" is caused to merge back onto the print path "PP" upstream of the fusing device 50 and down stream of the deposition device 40, thus positioning the given sheet to pass a second time through the fusing device without passing more than once through the deposition device.

The given sheet of media "M" then moves along the print path "PP" in the direction 130 and through the fusing device 50 a second time, whereupon the image is exposed to the hot roller 51 a second time at the normal processing speed of the fusing device and the print path. This multiple exposure of the image to the hot roller 51 of the fusing device 50 results in an increased gloss level of the image. The procedure of exposing the image to the hot roller 51 can be repeated as often as necessary in order to achieve the desired level of finish gloss.

It is understood that, in the alternative, a sheet of media "M" bearing an image which is not to have an increased gloss level is allowed by the shunting device 62 to proceed along the print path "PP" in the direction 130 directly from the fusing device to point "B" after only a single pass through the fusing device. That is, normal images which are not to have increased gloss levels are passed through the fusing device only once. Further, a sheet which is to have an increased gloss level applied thereto can be temporarily held in the fusing circuit 210 while a sheet which is not to have an increased gloss level applied thereto can pass through the fusing device and to point "B," after which the sheet temporarily held in the fusing circuit can then be moved back into the fusing circuit.

It is also understood that the fusing circuit 210 can be incorporated into a duplex circuit or the like. Duplex circuits are described above with respect to the prior art. As is illustrated in FIG. 4, the reversing leg 66 is depicted as a dotted line and is connected between the fusing circuit 210 and the print path "PP" upstream of the deposition device 40. Thus, the fusing circuit 210, in conjunction with the reversing leg 66, can function as a duplex circuit in the manner described above with respect to the prior art, wherein media "M" can move along the reversing leg 66 in the direction indicated by the arrows 131. Alternatively, the apparatus 200 can include a separate duplex circuit (not shown) of which the fusing circuit 210 does not comprise a portion thereof.

Figure 5:
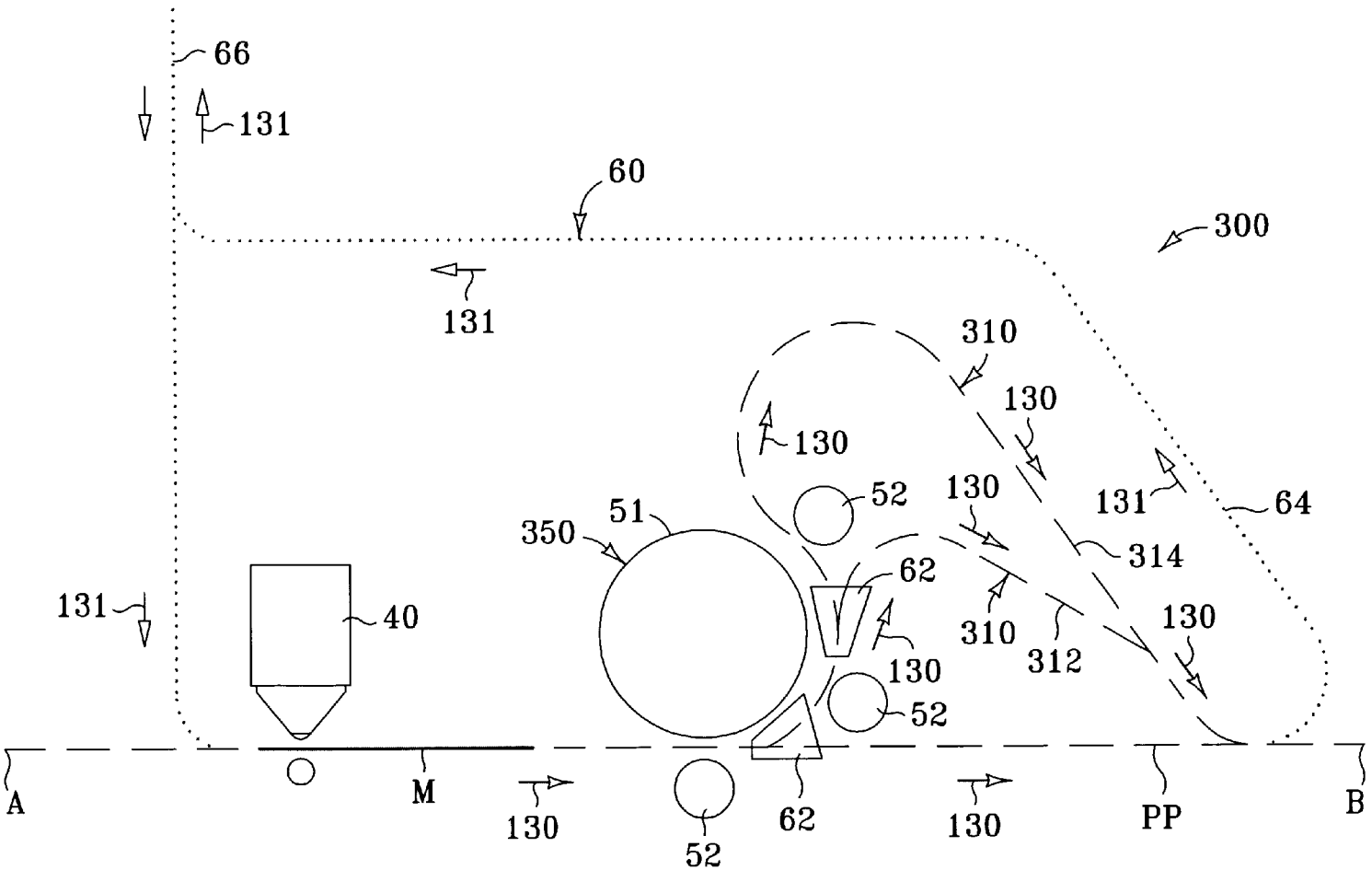
FIG. 5 is a side elevation schematic diagram depicting an imaging apparatus in accordance with yet another embodiment of the present invention.

Now moving to FIG. 5, a side-elevation schematic diagram is shown which depicts an imaging apparatus 300 in accordance with yet another embodiment of the present invention. The apparatus 300 comprises a fusing device 350. The fusing device 350 comprises a hot roller 51 and a plurality of pressure rollers 52. Hot rollers 51 and pressure rollers 52 are described above with respect to the prior art. As depicted in FIG. 5, the fusing device 350 comprises three pressure rollers 52.

However, it is understood that the fusing device 350 can alternatively comprise only two pressure rollers 52, or can comprise more than three pressure rollers. That is, the fusing device 350 comprises a plurality of pressure rollers 52. It is understood that, as in the cases of the apparatus 100 and 200, the fusing device 350, as well as the related components such as the print path "PP" and deposition device 40 of the apparatus 300, need not have the capability to operate at a decreased operating speed that is less than normal processing speed. The fusing device 350 will be further discussed below.

As is seen, the apparatus 300 can include a deposition device 40. The deposition device 40 has been explained above with reference to the prior art. The apparatus 300 preferably comprises a print path "PP" that leads from point "A" to point "B." That is, preferably, a print path "PP" is included in the apparatus 300, wherein the print path is configured to convey a sheet of image media "M" in the direction 130 from point "A" to point "B." As in the cases of the other apparatus which are discussed above, point "A" can be, for example, an in-feed tray (not shown) or the like, while point "B" can be an out-feed tray (not shown) or the like. The print path "PP" is preferably defined by known media conveying means as described above for the apparatus 100 and 200.

The apparatus 300 comprises a fusing circuit 310 which is preferably defined by various known means of guiding and conveying image media "M" along a given path, including various feed rollers (not shown), guides (not shown), passages (not shown) and the like. As will become apparent, a primary purpose of the fusing circuit 310 is to enable a given image to be repeatedly exposed to the hot roller 51 so as to increase the finish gloss of the given image.

A study of FIG. 5 reveals that the form of the fusing circuit 310 can be referred to as a "parallel siding" because the path of the fusing circuit resembles a railroad siding. The fusing circuit 310 can be described as "parallel" because the fusing circuit runs in a parallel manner relative to the print path "PP." Although the fusing circuit 310 is not necessarily strictly parallel to the print path "PP" in the geometrical sense, it is understood that the descriptive word "parallel" as used in reference to the fusing circuit 310 is meant to have a meaning in the sense of an electrical circuit or the like, as in "parallel resistors," for example.

The fusing circuit 310 can comprise multiple parallel legs as shown. That is, as specifically depicted, the fusing circuit 310 can comprise a first leg 312 and a second leg 314. The particular configuration depicted can thus be described as a "double parallel siding." It is understood that the fusing circuit 310 can alternatively comprise any number of legs depending on the level of gloss that the apparatus 300 is configured to provide as will be discussed further below.

For example, the fusing circuit 310 can alternatively have the form of a single parallel siding wherein the fusing circuit 310 would comprise only the first leg 312. It is noted that an additional pressure roller 52 is included in the apparatus 300 for every leg 312, 314. That is, the descriptive word "additional" refers to the pressure rollers 52 that are included over and above the standard single pressure roller of a prior art fusing device 50 which is described above with respect to the prior art.

As exemplified in FIG. 5, the apparatus 300 includes two additional pressure rollers 52 for a total of three pressure rollers because two legs 312, 314 are included. As a further example, in the case wherein the apparatus 300 is provided with only one leg 312, then only one additional pressure roller 52 would be provided for a total of two pressure rollers. In yet a further alternative configuration of the apparatus 300 which is not shown, a total of three legs can be included to form a triple parallel siding, and wherein three additional pressure rollers 52 would be provided for a total of four pressure rollers.

The apparatus 300 is also preferably provided with a shunting device 62 for each additional pressure roller 52 that is included in the apparatus. For example, as shown in FIG. 5, the apparatus 300 includes a total of two shunting devices 62 which correspond to the two additional pressure rollers 52 that are included in the apparatus. The shunting devices 62 can be controlled by way of a controller (not shown) or the like as described above with respect to the apparatus 100 and 200.

During operation of the apparatus 300, a sheet of media "M" is conveyed along the print path "PP" from point "A" in the direction 130. As the sheet of media "M" passes through the deposition device 40, an image is deposited onto the sheet of media. The sheet of media "M" continues along the print path "PP" in the direction 130 toward the fusing device 350. The sheet of media "M" passes through the fusing device 350 whereupon the image on the sheet is exposed to the hot roller 51 a first time. If the image is not to have an increased level of finish gloss, then the sheet of media "M" continues along the print path "PP" and proceeds directly from the fusing device 350 to point "B."

However, if the image is to have an increased level of finish gloss, then the sheet of media "M" can be diverted by way of the respective shunting device 62 onto the first leg 312 of the fusing circuit 310. On the first leg 312, the image is exposed to the hot roller 51 a second time as the sheet of media "M" moves in the direction indicated by the arrow 130. If the level of finish gloss is sufficient after the image has been exposed to the hot roller 51 a second time, then the sheet of media "M" continues along the first leg 312 so as to merge back onto the print path "PP" as is evident from a study of FIG. 5. The sheet of media "M" then moves along the print path "PP" to the point "B."

However, if the image requires yet an additional level of increased finish gloss after the second exposure of the image to the hot roller 51, then the sheet of media "M" can be diverted by way of the respective shunting device 62 directly from the first leg 312 and onto the second leg 314 of the fusing circuit 310. After sheet of media "M" is diverted onto the second leg 314 of the fusing circuit 310, the image is exposed to the hot roller 51 a third time. After exposure of the image a third time to the hot roller 51, the sheet of media "M" continues to move in the direction 130 along the second leg 314 so as to merge back onto the print path "PP." The sheet of media "M" then moves along the print path "PP" to point "B."

It is understood, as mentioned above, that the fusing circuit 310 can comprise additional legs (not shown), in which case the fusing device 350 would comprise an additional pressure roller 52, and an additional shunting device 62, for each additional leg in the manner depicted in FIG. 5. Thus, the apparatus 300 can be configured so that one of a number of available levels of finish gloss can be selected for a given image. That is, a user of the apparatus 300 can select one of a number of various levels of finish gloss to be applied to a given image. The selected finish gloss can then be applied to the given image by causing the respective shunting devices 62 to direct, or route, the sheet of media "M" bearing the given image through the appropriate legs of the fusing circuit 310 in order to achieve the desired level of finish gloss on the given image.

It is noted that the configuration of the fusing circuit 310 can prove advantageous in providing high-speed processing while maintaining a given sheet sequence in a print job in which different sheets bear images having different levels of finish gloss. That is, for illustrative purposes, two consecutive sheets of media "M" which are to bear images are considered. A first sheet of media "M" is to bear an image having an increased level of gloss while a following sheet is to bear an image having normal finish gloss. The first sheet of media "M" is thus diverted onto the fusing circuit 310 whereupon the respective image receives an increased level of gloss.

The following sheet of media "M" is not diverted onto the fusing circuit 310 and continues along the print path "PP" toward point "B." The fusing circuit 310 can accordingly be provided with high-speed feed rollers (not shown) or the like which are configured to move the first sheet of media "M" along the fusing circuit 310 at a rate that is substantially higher than the rate at which the following sheet is moved along the print path "PP." Thus, the first sheet of media "M," by moving faster than the following sheet, can "catch-up" to its original sequential position ahead of the following sheet before merging back onto the print path "PP."

As is further seen from FIG. 5, a duplex circuit 60 can be included in the apparatus 300 in order to provide duplex printing capability. Media "M" can be moved along the duplex circuit 60 in the directions indicated by the arrows 131. As described above with respect to the prior art, the duplex circuit 60 can comprise a half loop 64 and a reversing leg 66. As is also explained with respect to the prior art, the relative positions of the half loop 64 and reversing leg 66 can be reversed to provide an alternative configuration of the duplex circuit 60.

Figure 6:
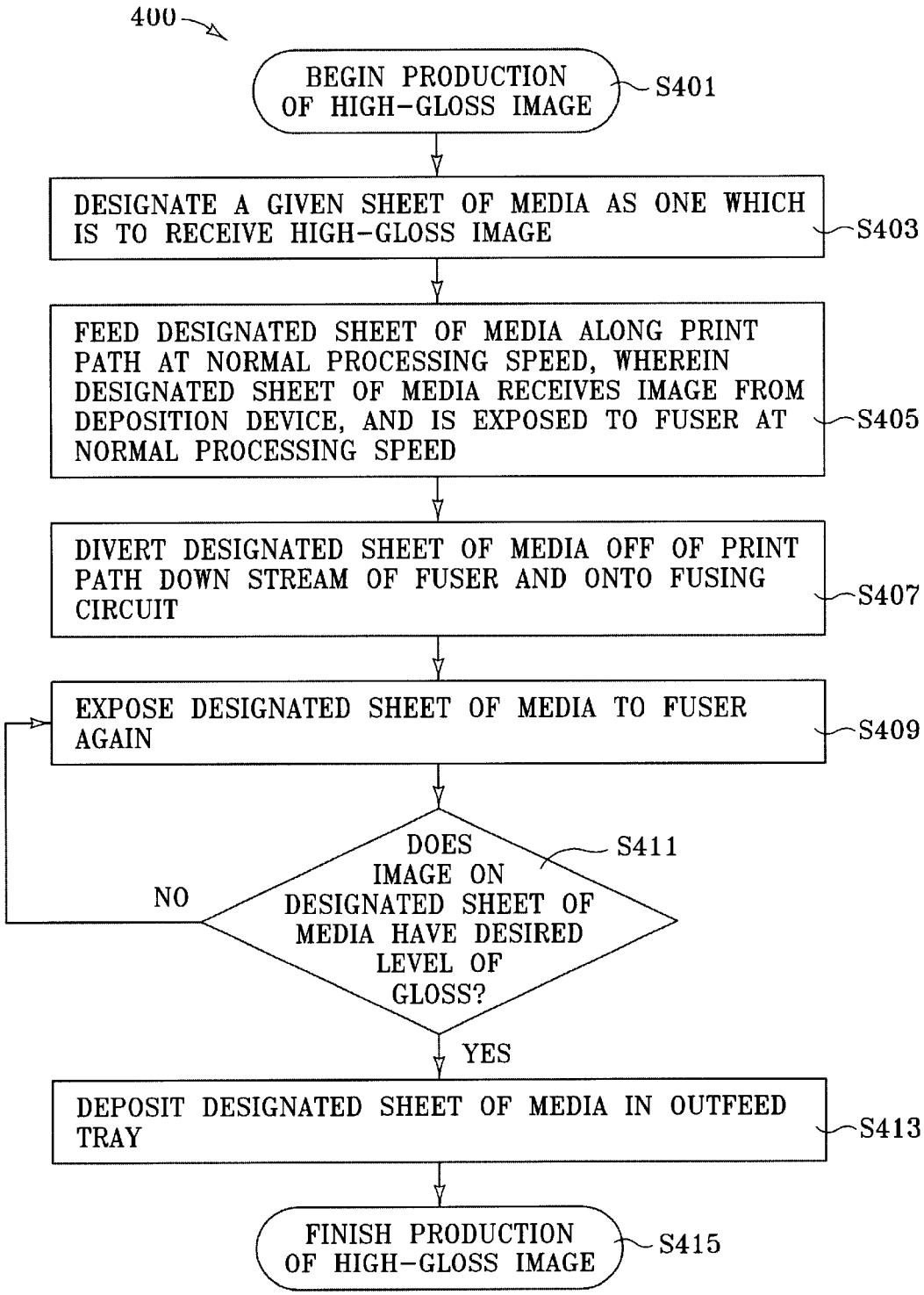
FIG. 6 is a flow chart which depicts steps of a procedure for producing an image having increased finish gloss in accordance with the present invention.

Moving now to FIG. 6, a flow diagram 400 is shown which depicts various steps in a process for providing increased levels of finish gloss in accordance with the present invention. The process illustrated by the flow diagram 400 can be utilized in conjunction with any apparatus of the present invention, including those apparatus which are specifically described and shown herein which comprise a print path, a deposition device, a fusing device, and a fusing circuit. The first step of the flow diagram is step S401, in accordance with which the production of an image having an increased level of finish gloss is commenced.

In accordance with the next step of S403, a given sheet of image media is designated as one that is to receive a high-gloss image. In accordance with step S405, the sheet of media is fed along the print path at normal processing speed, and through the deposition device at normal processing speed to produce an image on the sheet of media.

It is noted that the sheet of media is fed through the deposition device only once during the process illustrated by the diagram 400. Still in accordance with step S405, the image and the sheet of media are exposed to the fuser, or fusing device, a first time while the fusing device is operated at a normal processing speed. That is, during the exposure of the image and sheet of media to the fusing device, the processing speed of the fusing device is not decreased.

Proceeding to step S407, the image and that associated sheet of media are diverted off of the print path at a point that is down stream of the fuser, or fusing device. The sheet of media and the image supported thereon is then moved onto the fusing circuit. In accordance with the next step of S409, the sheet of media and the image supported thereon are merged back onto the print path up stream of the fusing device, or fuser, and exposed a second time to the fusing device to produce an increased level of finish gloss on the image. This second exposure to the fusing device is performed while the fusing device is operated at normal processing speed.

The following step of S411 is a query that asks if the image supported on the designated sheet of media has the desired level of gloss. If the answer to the query of step S411 is "no," then the process moves back to step S409, in accordance with which the designated sheet of media and the image supported thereon are exposed again to the fuser to cause an increase in the level of gloss of the image. From step S409, the process moves again to step S411 where the query thereof is asked again.

On the other hand, if the answer to the query of step S411 is "yes," then the process moves to the next step of S413, in accordance with which the designated sheet of media is moved past the fusing circuit on the print path without being diverted thereon, and is deposited in an outfeed tray for pickup by the user. In accordance with the following step of S415, the process of producing a high-gloss image on the designated sheet of image media is finished.

In accordance with still another embodiment of the present invention, a method of increasing the gloss of an image supported on a given sheet of media includes providing a deposition device and a fusing device. The method also includes exposing the image to the fusing device more than once without passing the given sheet of media through the deposition device more than once. That is, certain steps of the method can comprise exposing the image to the fusing device a first time and then a second time, while passing the associated image media through the deposition device only once to receive the image.

The image can likewise be exposed to the fusing device a third time, and can yet further be exposed a fourth time for corresponding increases in the level of image gloss. The fusing device can comprise a hot roller and a pressure roller, such as hot roller 51 and pressure roller 52 of FIGS. 3–5, wherein exposure to the fusing device can comprise exposure to the hot roller of the fusing device. Furthermore, such exposure to the fusing device is preferably performed at a normal processing speed of the fusing device.

Further steps of the method can comprise providing a print path along which the fusing device is operatively positioned. A deposition device can also be provided and operatively positioned along the print path in accordance with the method. The method can thus include diverting the image off of the print path downstream of the fusing device and merging the image back onto the print path upstream of the fusing device but downstream of the deposition device.

The method can include moving the image from downstream of the fusing device to upstream of the fusing device on a circuit having a Siamese Wishbone form, as for example the form depicted in FIG. 3. Alternatively, the method can include moving the image from downstream of the fusing device to upstream of the fusing device on a circuit having a Full Loop form, as for example the form depicted in FIG. 4.

The method can comprise the step of providing a fusing device having a hot roller and a plurality of pressure rollers, as for example the form depicted in FIG. 5. A further step in the method comprises exposing the image to the hot roller a plurality of times by feeding the image between the hot roller and each of the plurality of pressure rollers. This step can be performed while the fusing device is operated at a normal processing speed.

The method can further include providing a fusing circuit in the form of a Parallel Siding, wherein the fusing circuit has a first leg, as for example the form depicted in FIG. 5. The fusing circuit can also have a second leg (e.g., leg 314 of FIG. 5) wherein the fusing circuit would thus have a Double Parallel Siding form. The method can thus comprise the steps of diverting the image from the print path and onto the first leg. The method can also comprise diverting the image from the first leg and onto the second leg.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An imaging apparatus for producing an image on a sheet of media, comprising:

a print path;

a fusing device operatively positioned on the print path and having a hot roller and at least one pressure roller;

a deposition device operatively positioned on the print path upstream of the fusing device; and, a fusing circuit operatively connected with the print path only downstream of the deposition device, whereby the sheet of media is selectively moved along the fusing circuit and the image thereon is repeatedly exposed to the hot roller without passing through the deposition device.

2. The apparatus of claim 1, wherein the fusing circuit is substantially in the form of a full loop.

3. The apparatus of claim 1, and further comprising:

a duplex circuit operatively incorporated into the fusing circuit and configured to turn the sheet of media over and move the sheet of media upstream of the deposition device.

4. The apparatus of claim 3, wherein the fusing circuit branches off of the duplex circuit.

5. The apparatus of claim 1, and further comprising a shunting device operatively positioned on the print path, whereby a predetermined sheet of media is selectively diverted from the print path and onto the fusing circuit as the result of selective operation of the shunting device.

6. The apparatus of claim 1, and further comprising:

a fusing device located on the print path downstream of the deposition device, wherein the fusing circuit substantially circumscribes the fusing device, and the deposition device lies outside the fusing circuit.

7. A method of increasing the gloss of an image formed on a sheet of media, comprising:

providing a fusing device;

providing a deposition operatively connected with the print path upstream of the fusing device, whereby an image is selectively formed on the sheet of media during passage thereof through the deposition device; and, repeatedly exposing the image to the fusing device without passing the sheet of media through the deposition device only.

8. The method of claim 7, and wherein the fusing device has a hot roller, the method further comprising:

exposing the image to the hot roller a first time; and, exposing the image to the hot roller a second time.

9. The method of claim 8, and further comprising exposing the image to the hot roller a third time.

10. The method of claim 7, wherein the deposition device is located up stream of the fusing device, the method further comprising:

removing the image from the print path downstream of the of the fusing device; and, merging the image back onto the print path upstream of the fusing device and downstream of the deposition device.

11. The method of claim 7, and wherein the fusing device is configured to operate at a normal processing speed during exposure of the image thereto.

* * * * *

UNITED STATES PATENT AND TRADEMARK OFFICE

CERTIFICATE OF CORRECTION

PATENT NO. : 6,679,600 B1
DATED : January 20, 2004
INVENTOR(S) : Laurent A. Regimbal It is certified that error appears in the above-identified patent and that said Letters Patent is hereby corrected as shown below:

Column 20,
Line 6, after "deposition" insert -- device --

Signed and Sealed this

Twenty-sixth Day of July, 2005

JON W. DUDAS
*Director of the United States Patent and Trademark Office*